US006783232B2

(12) United States Patent
Takahashi et al.

(10) Patent No.: US 6,783,232 B2
(45) Date of Patent: Aug. 31, 2004

(54) PRINTER WITH PHOTO STAND AND PHOTO STAND DETACHABLY ATTACHABLE TO PRINTER

(75) Inventors: Toshihiro Takahashi, Nagoya (JP); Satoru Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 49 days.

(21) Appl. No.: 10/023,803

(22) Filed: Dec. 21, 2001

(65) Prior Publication Data

US 2003/0020797 A1 Jan. 30, 2003

(30) Foreign Application Priority Data

Jul. 30, 2001 (JP) ..... 2001-228852

(51) Int. Cl.[7] ..... B41J 29/13
(52) U.S. Cl. ..... 347/108
(58) Field of Search ..... 347/108, 109; 40/797–799, 765, 611; 346/143; 358/335, 185, 214–216; 400/88; D18/55, 50, 12, 14

(56) References Cited

U.S. PATENT DOCUMENTS 2,535,743 A 12/1950 Lundahl
4,808,021 A 2/1989 Kelly ..... 400/717
5,057,933 A * 10/1991 Takahashi ..... 358/335
D413,142 S * 8/1999 Pangburn ..... D18/55
6,067,738 A * 5/2000 Zeligson ..... 40/611
6,557,992 B1 * 5/2003 Dwyer et al. ..... 347/108

FOREIGN PATENT DOCUMENTS

EP 1 056 067 A2 11/2000
JP 2001-16536 1/2001

OTHER PUBLICATIONS

HP Apollo P–2500 USB Port color Printer from Hewlett Packard (can be found on the Internet).*

* cited by examiner

*Primary Examiner*—Stephen D. Meier
*Assistant Examiner*—An H. Do
(74) *Attorney, Agent, or Firm*—Oliff & Berridge, PLC

(57) ABSTRACT

A printer with a photo stand is constructed by which the photo stand is attached to the tape printer so as to cover a left side surface of a housing of the tape printer. In the printer with the photo stand, the tape printer is inclined with respect to an installed plane. With this structure, a photograph held in the photo stand is oriented toward a direction that a picture side of the photograph can be easily seen. A protrusion is provided to a lower surface of a cover of the tape printer, so that the printer with the photo stand can be prevented from falling in an inclined direction of the tape printer. The photo stand can be attached to the tape printer to form a single-piece unit, so that the printer with the photo stand saves space while displaying the photograph.

22 Claims, 12 Drawing Sheets

PRINTER WITH PHOTO STAND AND PHOTO STAND DETACHABLY ATTACHABLE TO PRINTER

BACKGROUND OF THE INVENTION

1. Field of Invention

The invention relates to a printer, and more particularly, to a printer to which a photo stand is detachably attached and a photo stand detachably attachable to the printer.

2. Description of Related Art

Conventionally, small and compact printers that have a tape wound therein and print indicia, such as characters and symbols, on the tape, have been used in offices, schools and the like. Labels on which characters and symbols are printed by the printer are adhered to office automation equipment, stationery and the like. The printers are small in size, so that the printers are used on desks in the offices and schools.

In the offices and schools, there are many cases where people display photographs of their families and friends on their desks. Accordingly, desktop work space becomes confined or a place for locating a keyboard, a mouse, documents or stationery is limited.

SUMMARY OF THE INVENTION

The invention provides a printer with a photo stand in which a photograph can be displayed and that requires less space than a conventional printer and conventional photo stand and a photo stand detachably attachable to the printer.

According to one aspect of the invention, a printer with a photo stand that prints indicia on a recording medium includes an outer surface, a plurality of engagement portions formed on the outer surface, and a photo stand that is detachably attached to the engagement portions and can hold a photograph therein.

In the printer with the photo stand as structured above, the photo stand is detachably attached to the printer. When the printer and the photo stand are to be placed on a desk, it is unnecessary to place the printer and the photo stand separately. Accordingly, the desk space can be saved and effectively used.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
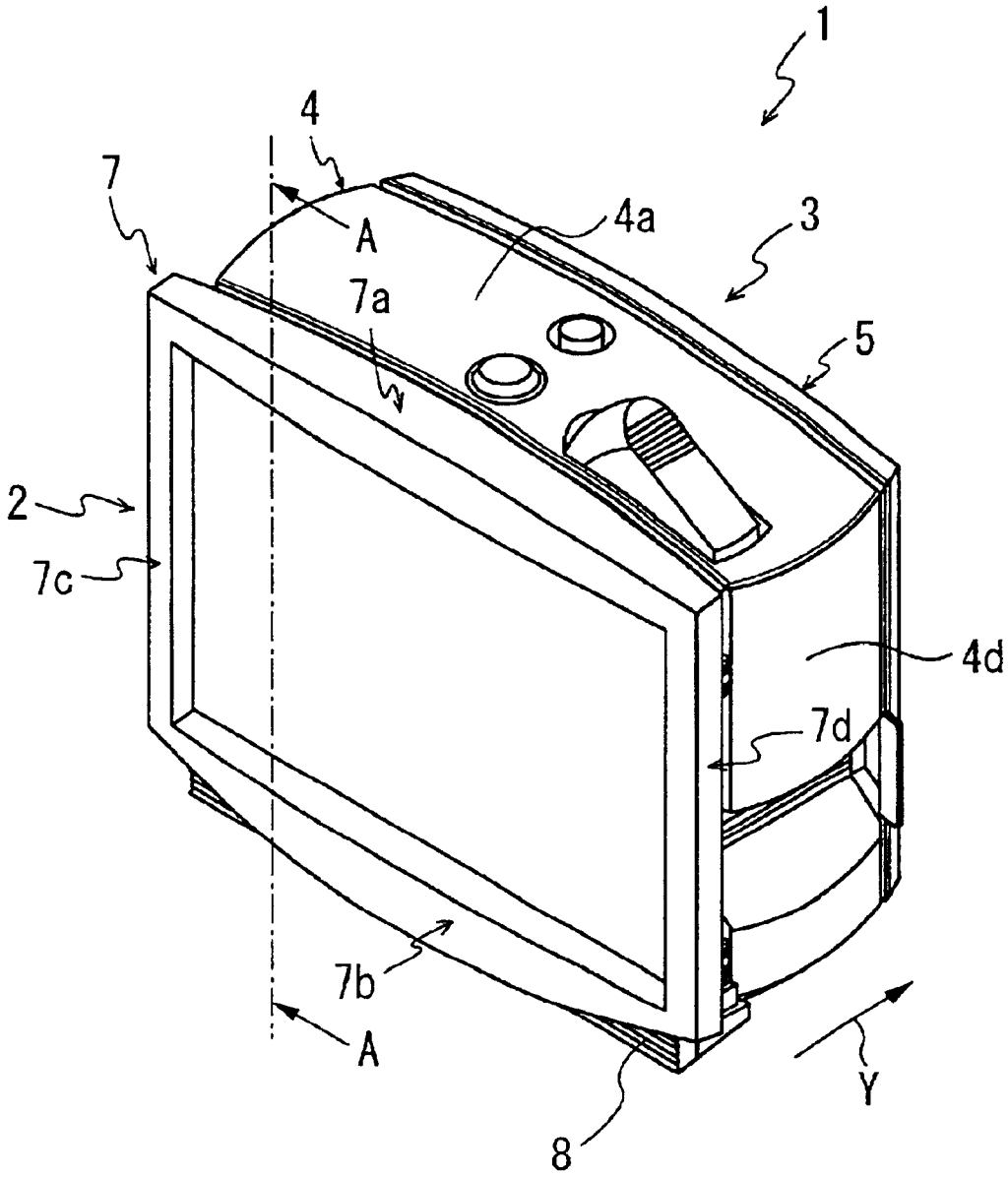
FIG. 1 is a perspective view showing a printer with a photo stand.

An embodiment of a printer with a photo stand of the invention will be described with reference to the accompanying drawings. In this embodiment, a printer with a photo stand that is structured such that a photo stand is attached to a tape printer is taken as an example. Referring to FIG. 1, an appearance of a printer with a photo stand 1 will be described.

Figure 4:
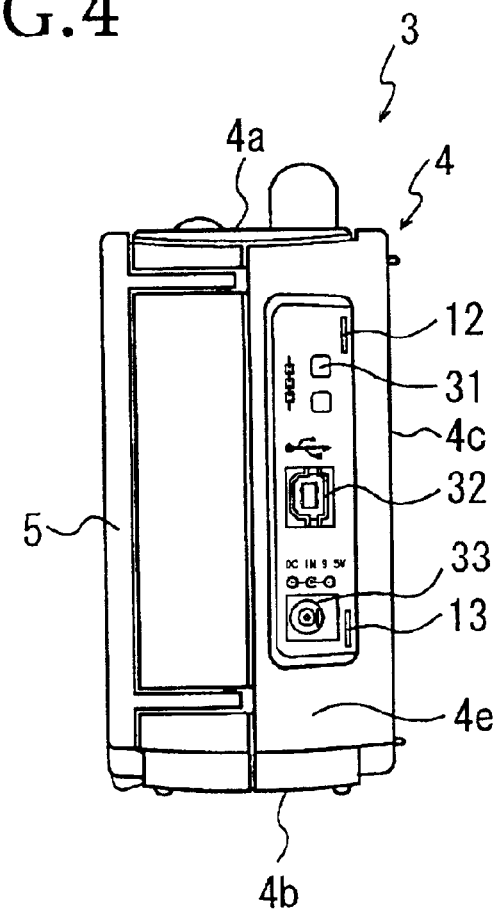
FIG. 4 is a rear view of the tape printer.

As shown in FIG. 1, the printer with a photo stand 1 is designed such that a photo stand 2 is detachably attached to a tape printer 3. The tape printer 3 includes a housing 4 that has five outer surfaces, an upper surface 4*a*, a lower surface 4*b* (FIG. 5), a left side surface 4*c* (FIG. 2), a front surface 4*d* and a rear surface 4*e* (FIG. 4). The housing 4 does not have a right side surface, so that the right side of the housing 4 is open (not shown). A cover 5 is rotatably provided to the right side of the housing 4. When the cover 5 is closed with respect to the right side of the housing 4, an open portion (not shown) in the right side of the housing 4 is covered with the cover 5. A motor drive circuit 72 (described later), a tape feeding motor 73 (FIG. 6) and the like are built into the housing 4. As described above, the tape printer 3 is structured by the cover 5 and the housing 4 accommodating the circuit 72, the mechanism and the like. The tape printer 3 can print indicia, such as characters and symbols, on a tape, which is wound in a tape cartridge (not shown). The tape cartridge is detachably attached to the inside of the tape printer 3 by opening the cover 5.

Figure 7:
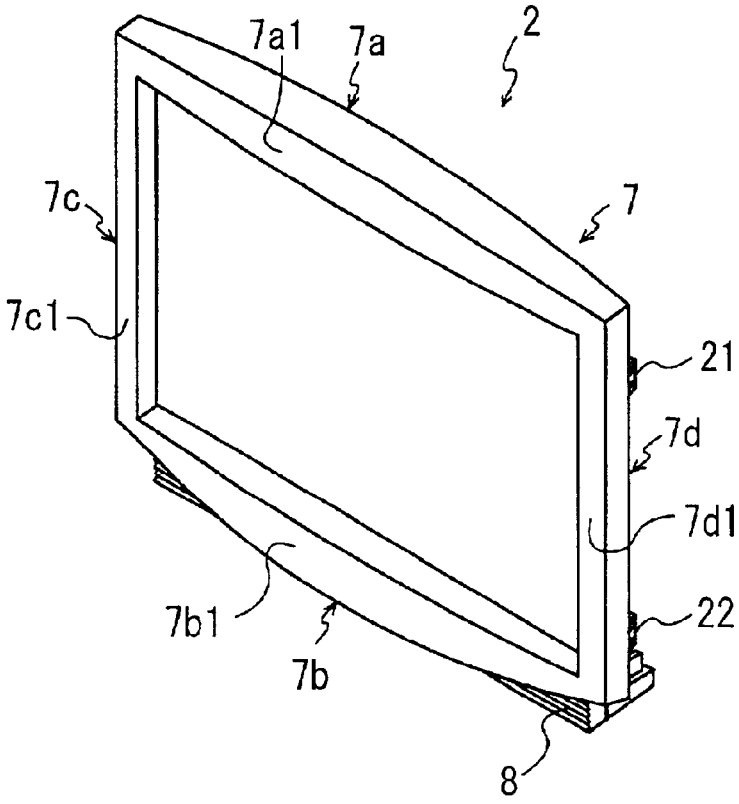
FIG. 7 is a perspective view showing a photo stand.

In the embodiment, the photo stand 2 is attached to tape printer 3 on the left side surface 4*c*. For convenience, in a frame 7 of the photo stand 2, frame portions provided on the sides of the upper surface 4*a*, the lower surface 4*b*, the front surface 4*c* and the rear surface 4*c* are referred to as an upper frame portion 7*a*, a lower frame portion 7*b*, a right side frame portion 7*d* and a left side frame portion 7*c*, respectively. As shown in FIG. 7, the photo stand 2 includes the substantially rectangular frame 7, which has the upper frame portion 7*a*, the lower frame portion 7*b*, the left side frame portion 7*c* and the right side frame portion 7*d*, and a bottom portion 8, which extends in a Y-axis direction in FIG. 1. The photo stand 2 can be attached to the tape printer 3 so as to cover the left side surface 4*c* of the tape printer 3. Photographs, small calendars or the like, can be placed in the photo stand 2 attached to the tape printer 3.

Figure 2:
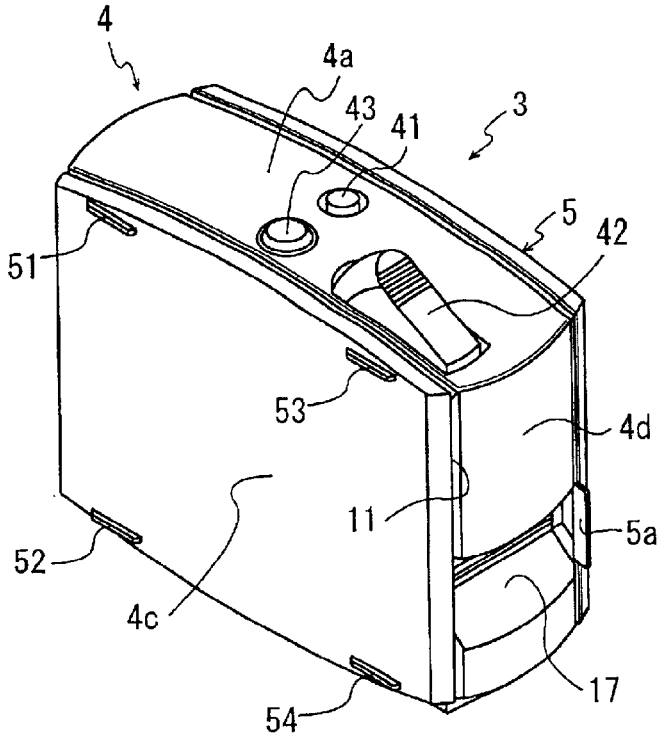
FIG. 2 is a perspective view showing a tape printer.
Figure 3:
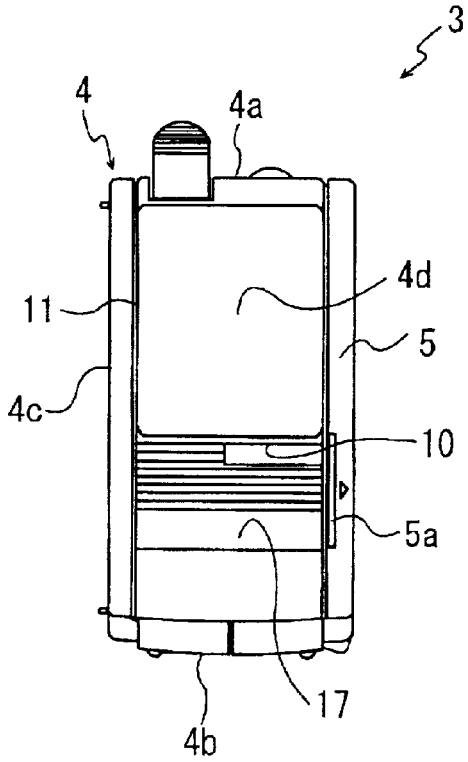
FIG. 3 is a front view of the tape printer.

The housing 4 of the tape printer 3 is made of synthetic resin material. As shown in FIGS. 2 to 4, the tape printer 3 includes the housing 4 that has the upper surface 4*a*, the lower surface 4*b*, the left side surface 4*c*, the front surface 4*d* and the rear surface 4*e*. The housing 4 does not have the right side surface, so that the right side of the housing 4 is open (not shown). The cover 5 is rotatably provided to the right side of the housing 4. When the cover 5 is closed, an open portion (not shown) in the right side of the housing 4 is covered with the cover 5. A projection 5*a* is formed at a side edge of the cover 5 on the side of the front surface 4*d*. By pressing the projection 5*a* rightward in FIG. 2, the cover 5 can be easily opened. Each surface 4*a* to 4*d* has a pair of sides that are convexly curved outward, so that the surfaces 4*a* to 4*d* have a substantially rectangular shape. Each pair of the upper surface 4*a* and the lower surface 4*b*, the front surface 4*d* and the rear surface 4*e*, and the left side surface 4*c* and the cover 5, are symmetrical to each other. The motor drive circuit 72 (described later), the tape feeding motor 73 (FIG. 6) and the like are built into the housing 4. The tape printer 3 can print indicia, such as characters and symbols, on a tape, which is wound in a tape cartridge (not shown).

As shown in FIGS. 2 and 3, a recessed portion 17, which is recessed toward the inward of the tape printer 3, is formed at a lower portion of the front surface 4*d* of the housing 4. By inserting a finger into the recessed portion 17, it becomes easier to press rightwardly in FIG. 3 the projection 5*a* formed to the cover 5. Accordingly, the cover 5 can be easily opened. A tape outlet 10, which is a substantially rectangular through hole, is formed in at a upper portion in a back wall on the side of the cover 5 to discharge the tape (not shown) therefrom. A tape cutter for cutting the tape (not shown) is provided near the tape outlet 10 in the housing 4. The tape drawn from the tape outlet 10 is cut into an appropriate length by the tape cutter. An engagement groove 11 is provided on the left side of the front surface 4*d*, from the upper end to the lower end, and is substantially parallel with a longitudinal direction of the front surface 4*d*. The engagement groove 11 is engaged with engaging protrusions 21, 22 formed to the frame 7 of the photo stand 2 (see FIG. 7).

As shown in FIG. 4, a chain hook 31, a type B port 32, a receptacle 33 are aligned from top downward on the right half of the back surface 4*e* of the housing 4. An antitheft chain (not shown) is hooked on the chain hook 31. The type B port 32 is connected with a USB type B connector to make connection between the tape printer 3 and a personal computer using a USB cable. A power supply plug for supplying power to the tape printer 3 is inserted into the receptacle 33. Engagement grooves 12 and 13 are provided at the right upper and lower portions, respectively. Engaging protrusions 23, 24 (FIG. 7) formed to the frame 7 of the photo stand 2 are engaged with the engagement grooves 12, 13, respectively. The cover 5 is rotatably held on the side of the rear surface 4e to cover the open portion formed in the right side of the housing 4.

Figure 5:
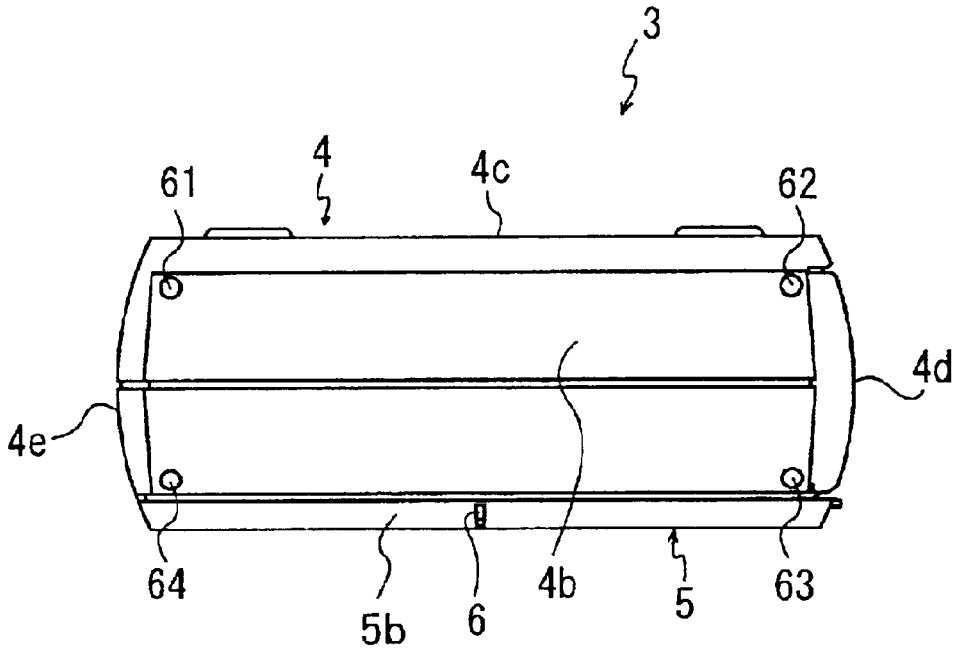
FIG. 5 is a bottom view of the tape printer.
Figure 10:
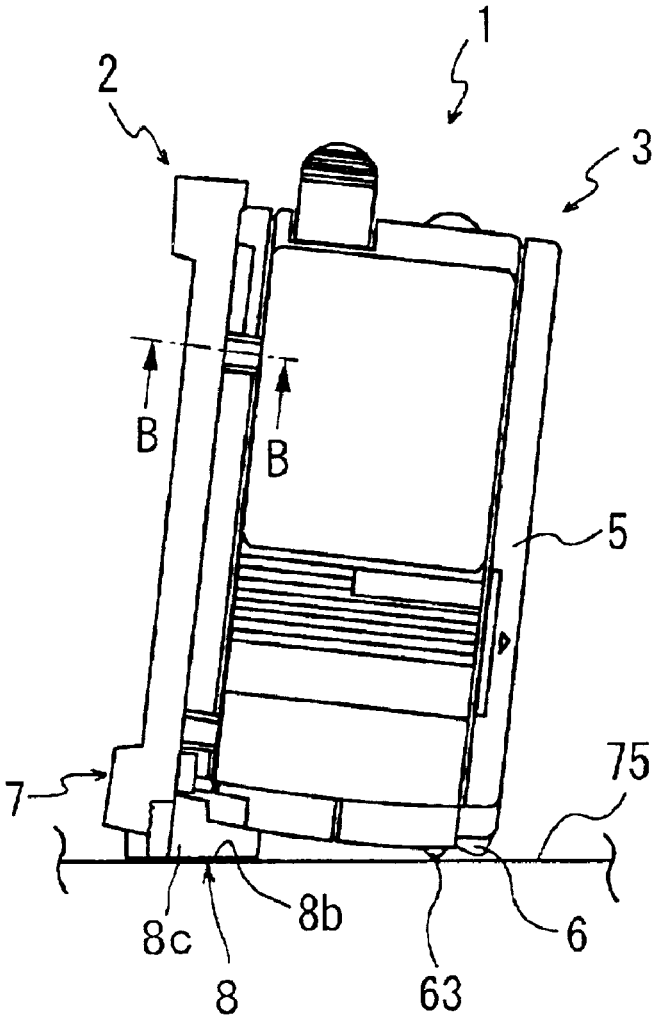
FIG. 10 is a front view showing the printer with the photo stand.

As shown in FIG. 5, four protruding feet 61 to 64 are provided on the lower surface 4*b* of the housing 4. The feet 61 to 64 are equally disposed at four corners of the lower surface 4*b*, when viewed from the lower surface 4*b*. The tape printer 3 can stand straight by the feet 61 to 64 with respect to an installed plane 75 of the tape printer 3 (FIG. 10). A protrusion 6 is provided at the middle of a lower surface 5*b* of the cover 5 provided on the right side of the housing 4. As shown in FIG. 10, when the photo stand 2 is attached to the left side surface 4*c* of the tape printer 3, the tape printer 3 inclined rightwardly with respect to the installed plane 75 can be prevented from falling toward the right in FIG. 10.

As shown in FIG. 2, a power button 41, a tape cut button 42 and an LED 43 are provided to the upper surface 4*a* of the housing 4. The power button 41 and the LED 43 are provided next to each other at the middle in the longitudinal direction of the upper surface 4*a*. The tape cut button 42 is provided on the upper surface 4*a* near the front side 4*d*. When the power button 41 is pressed while the power of the tape printer 3 is off, the tape printer 3 is turned on. When the power button 41 is pressed for a predetermined length of time or more while the power of the tape printer 3 is on, the tape (not shown) stored in the housing 4 is advanced to take up slack in the tape. When the tape cut button 42 is pressed, the tape that comes out from the tape outlet 10 is substantially perpendicularly cut into an appropriate length with respect to a tape feeding direction by the tape cutter (not shown) provided near the tape outlet 10.

Low protrusions 51 to 54, which are a rectangular parallelepiped, are provided on the left side surface 4*c* of the housing 4. The protrusions 51 and 53 are provided in positions at the same height. The protrusions 52 and 54 are provided in positions at the same height. The protrusions 51 to 54 are equally positioned at four corners of the left side surface 4*c*, when viewed from the left side surface 4*c*. A photograph 20 held by the photo stand 2 can be prevented from being vertically displaced by the protrusions 51 to 54 while the photo stand 2 is attached to the tape printer 3.

Figure 6:
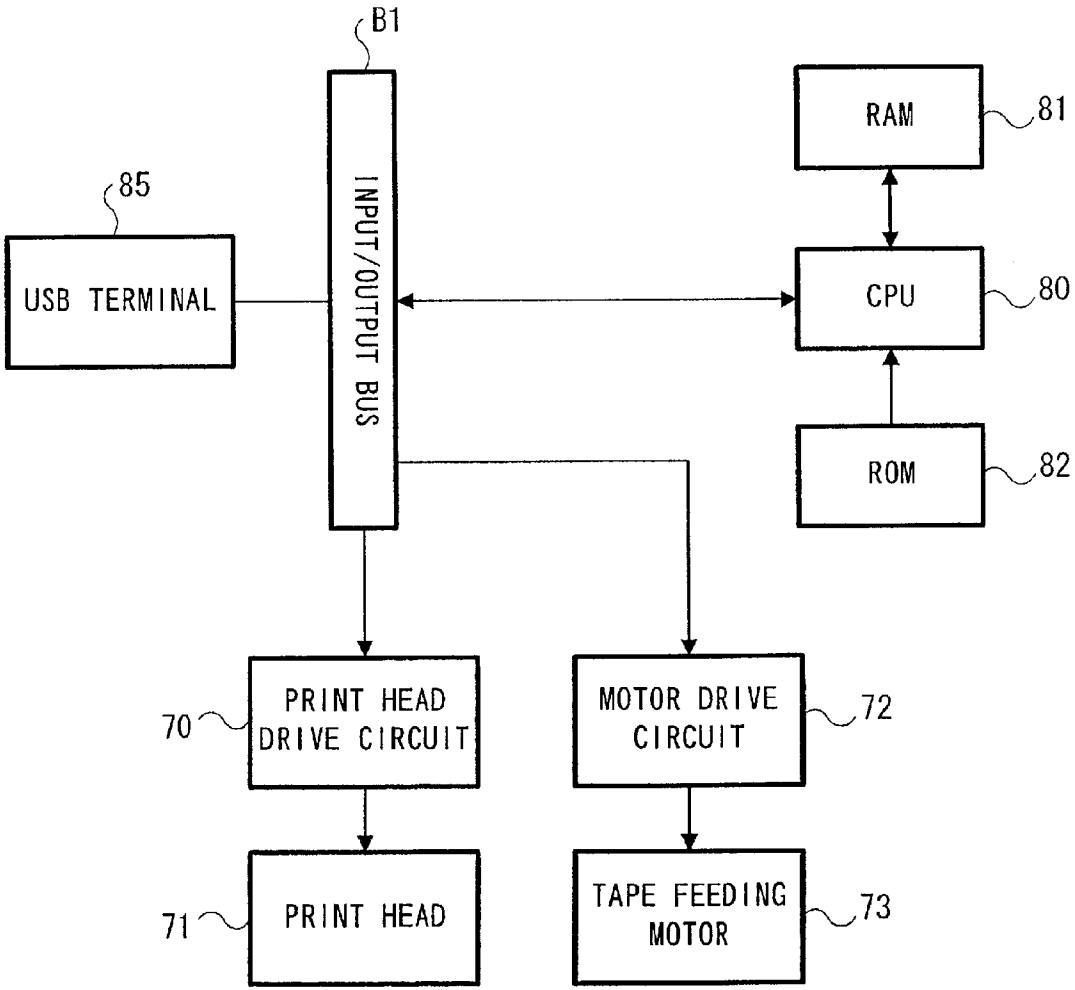
FIG. 6 is a schematic block diagram showing an electric configuration of the tape printer.

As shown in FIG. 6, the tape printer 3 includes a CPU 80 that controls the tape printer 3. The CPU 80 is connected with a RAM 81 that temporarily stores data and a ROM 82 that stores various kinks of control programs. The CPU 80 is also connected with a print head drive circuit 70, the motor drive circuit 72 and with a USB terminal 85 via an input/output bus B1. The print head drive circuit 70 and the motor drive circuit 72 are connected with a print head 71 and the tape feed motor 73, respectively. The tape printer 3 can be connected with a personal computer (not shown) by connecting the USB cable (not shown) to the USB terminal 85.

Figure 8:
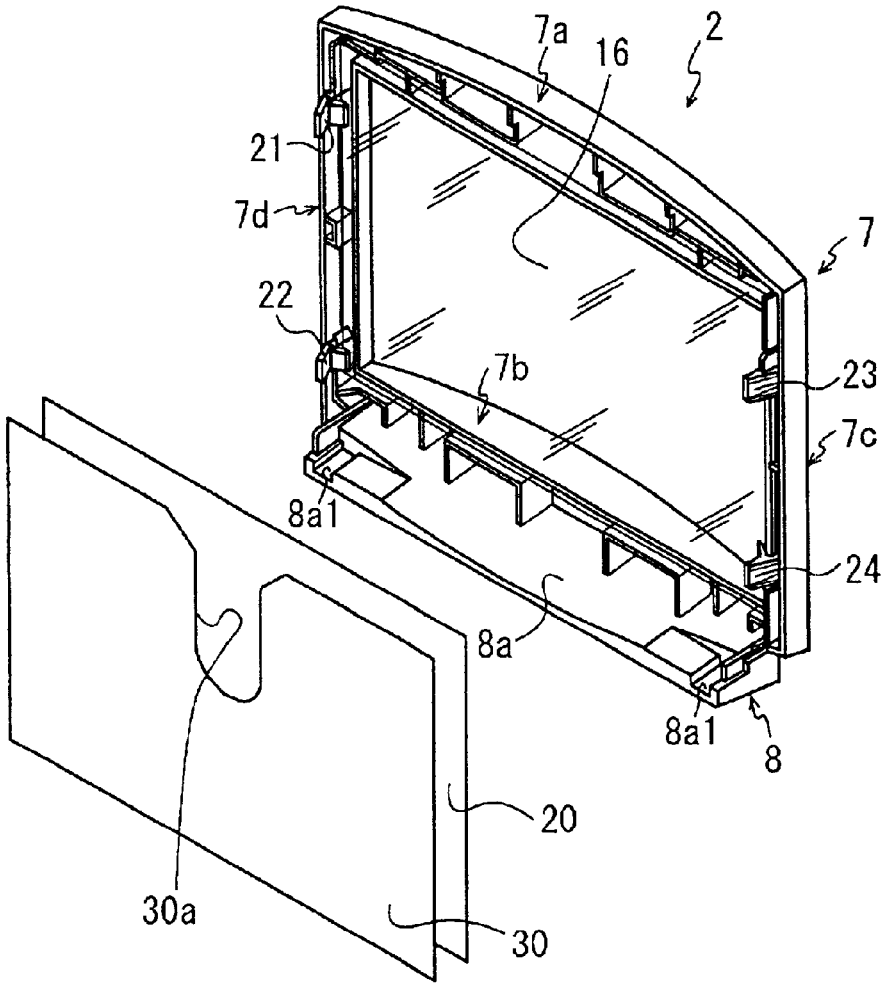
FIG. 8 is a perspective view showing the photo stand.
Figure 9:
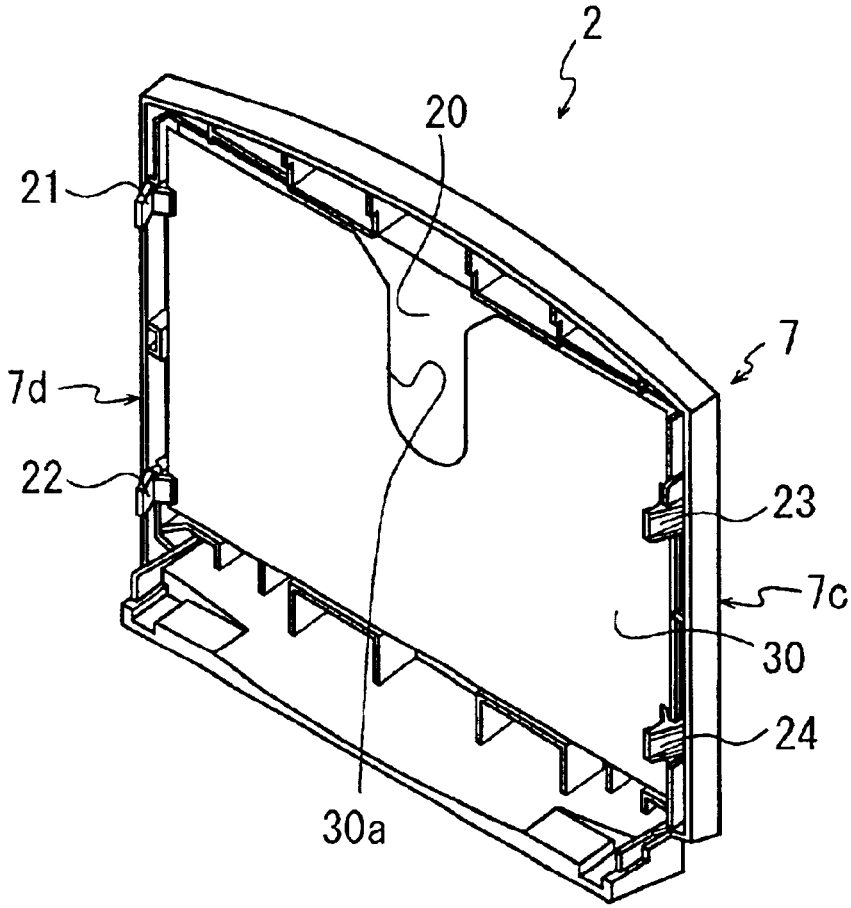
FIG. 9 is a perspective view showing the photo stand that holds a photograph.

The photo stand 2 is made of synthetic resin material. As shown in FIGS. 7 to 9, the photo stand 2 includes the substantially rectangular frame 7 having the upper frame portion 7*a*, the lower frame portion 7*b*, the left side frame portion 7*c* and the right side frame portion 7*d*. The middle portion of the frame 7 is substantially rectangularly open. The upper frame portion 7*a* and the lower frame potion 7*b* are longer than the right and left side frame portions 7*c*, 7*d*. A surface 7*a*1 of the upper frame portion 7*a* is convexly curved such that a substantially middle portion of the surface 7*a*1 in the longitudinal direction is uplifted. A surface 7*b*1 of the lower frame portion 7*b* has the same shape. A surface 7*c*1 of the left side frame portion 7*c* and a surface 7*d*1 of the right side frame portion 7*d* are convexly curved such as substantially middle portions of the surfaces 7*c*1 and 7*d*1 are uplifted in accordance with the shape of the surfaces 7*a*1, 7*b*1 of the upper and lower frame portions 7*a*, 7*b*. The bottom portion 8 extends from the lower frame portion 7*b* of the frame 7, toward the rear side of the photo stand 2.

As shown in FIG. 10, in the bottom 8, a projected portion 8*c* inclinatorily projects toward the upper frame portion 7*a* from a lower surface 8*b*, forming an acute angle with the lower surface 8*b*. The lower surface 8*b* is parallel with the installed plane 75, so that the tape printer 3 to which the photo stand 2 is attached at the left side surface 4*c* is rightwardly inclined with respect to the installed plane 75 in FIG. 10.

As shown in FIG. 8, right and left side end portions of an upper surface 8*a* of the bottom portion 8 is formed with a recessed portion 8*a*1. This prevents the feet 61, 62 provided on the lower surface 4*b* of the housing 4 of the tape printer 3 from interfering with the upper surface 8*a* of the bottom portion 8 when the photo stand 2 is attached to the tape printer 3.

The engaging protrusions 23, 24 protrude from the rear of the left side frame portion 7*c* of the frame 7. More particularly, the engaging protrusions 23 and 24 are disposed at the upper and lower portions of the left side frame portion 7*c*, respectively. The engaging protrusions 23 and 24 are mirror images of each other. The engaging protrusions 21 and 22 protrude from the read of the right side frame portion 7*d*. The engaging protrusions 21 and 22 are disposed at the upper and lower portions of the right side frame portion 7*d*, respectively. The engaging protrusions 21 and 23 are provided at the substantially same height. The engaging protrusion 22 is disposed near a lower end portion of the right side frame portion 7*d*.

Figure 11:
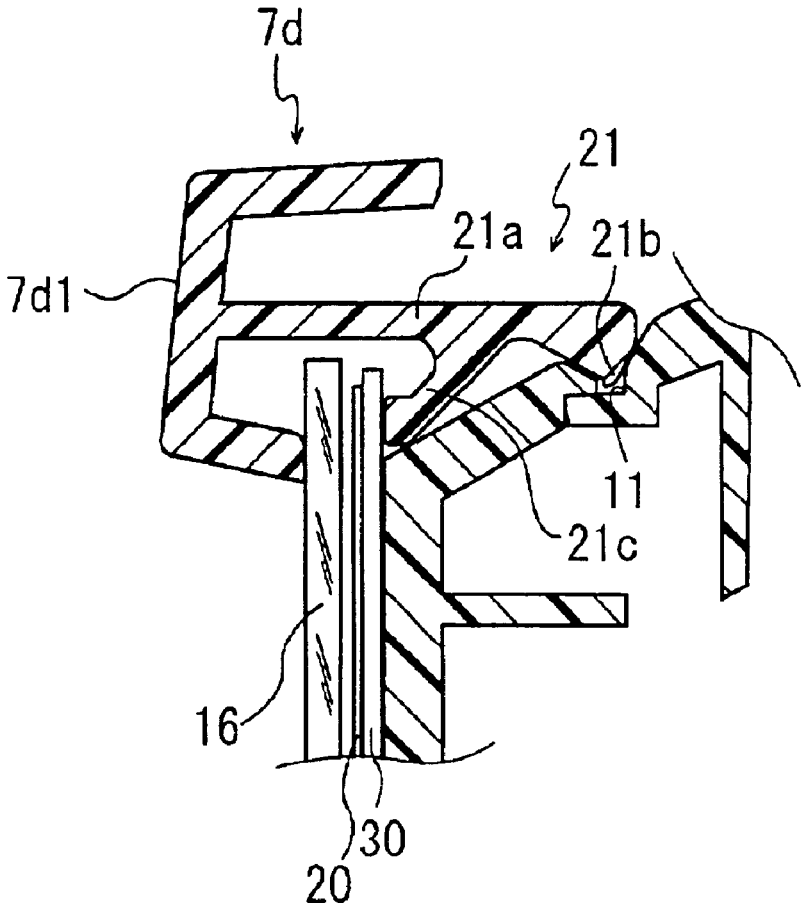
FIG. 11 is a sectional view taken along the line B—B of FIG. 10, looking in the direction of the appended arrows.

The engaging protrusions 21 to 24 have the substantially same shape. As shown in FIG. 11, for example, the engaging protrusion 21 includes a base portion 21*a*, a pawl portion 21*b* formed at an edge of the base portion 21*a*, and a photo holding portion 21*c* protruding from the base portion 21*a*. When the photo stand 2 is attached to the tape printer 3, the base portion 21*a* warps upward in FIG. 11 and the pawl portion 21*b* engages the engagement groove 11 provided in the front surface 4*d* of the housing 4 of the tape printer 3. The photograph 20 held by the photo stand 2 is urged from its rear by the photo holding portion 21*c* via a cardboard 30 provided behind the photograph 20. The engaging protrusions 22 to 24 have the same structure as the engaging protrusions 21. Accordingly, the photograph 20 is held in the photo stand 2 while urged from its rear by photo holding portions (not shown) provided to the engaging protrusions 22 to 24, in addition to the photo holding portion 21*c*. When the photo stand 2 is attached to the tape printer 3, base portions (not shown) provided to the engaging protrusions 22 to 24 also outwardly warp and pawl portions (not shown) formed to the respective base portions engage the respective engagement grooves 11 to 13 provided in the front and rear surfaces 4*d*, 4*e* of the housing 4 of the tape printer 3.

As shown in FIG. 8, the frame 7 of the photo stand 2 is provided with a substantially rectangular transparent panel 16. A portion of the transparent panel 16 is inserted between the right side frame portion 7*d* of the frame 7 and the engaging protrusion 21 provided at the rear of the right side frame portion 7*d*. Other portions of the transparent panel 16 are also inserted between the frame portions 7*c*, 7*d* and the engaging protrusions 22, 23, 24. The photo stand 2 holds the photograph 20 while sandwiching the photograph 20 by the cardboard 30 having the substantially same size as the transparent panel 16. The photograph 20 can be seen through the transparent panel 16 from a side opposite to the cardboard 30. The cardboard 30 has a substantially rectangular shape. A U-shaped cutaway portion 30*a* is formed in the cardboard 30 by which the cardboard 30 is partially cut away from an upper edge at a substantially middle portion in the longitudinal direction. As shown in FIGS. 9 and 11, the photograph 20 is inserted between the frame portions 7*c*, 7*d*, and the engaging protrusions 21 to 24. The cardboard 30 is also inserted therebetween and behind the photograph 20 (the right of the photograph 20 in FIG. 11). By doing so, the photograph 20 can be held in the photo stand 2 while seen from a picture side through the transparent panel 16.

In the bottom portion 8, the projected portion 8*c* inclinatorily projects toward the upper frame portion 7*a* from the lower surface 8*b*, forming an acute angle with the lower surface 8*b*. Therefore, when the photo stand 2 is attached to the tape printer 3, the tape printer 3 is inclined rightward in FIG. 10 with respect to the installed plane 75. In this state, the bottom portion 8 of the photo stand 2 becomes a bottom portion of the printer with the photo stand 1 constructed by the photo stand 2 and the tape printer 3. For example, when the photo stand 2 is used separately from the tape printer 3 to display the photograph 20 or the like, the frame 7 is inclined backward with respect to an installed plane on which the photo stand 2 is placed, that is, the bottom portion 8. Accordingly, the photograph 20 inserted in the photo stand 2 is oriented toward a direction that the picture side of the photograph 20 can be easily seen. As shown in FIG. 9, the cardboard 30, which is provided behind of the photograph 20, is formed with the cutaway portion 30*a* at its upper portion. Therefore, the photograph 20 can be upwardly pulled out of the photo stand 2 via the cutaway portion 30*a* using a finger, without removing the transparent panel 16 and the cardboard 30.

As shown in FIGS. 1, and 10 to 12, the printer with the photo stand 1 is structured such that the photo stand 2 is attached to the left side surface 4*c* of the housing 4 of the tape printer 3. The photo stand 2 is attached to the tape printer 3 as described below. First, the engaging protrusions 23, 24 (FIG. 8) provided to the left side frame portion 7*c* of the frame 7 of the photo stand 2 are engaged with the engagement grooves 12, 13 (FIG. 4), respectively, provided to the rear surface 4*e* of the tape printer 3. Then, the engaging protrusions 21, 22 (FIG. 7) provided to the right side frame portion 7*d* of the frame 7 of the photo stand 2 are engaged with the engagement groove 11 (FIG. 3) provided to the front surface 4*d* of the tape printer 3. Thus, the left side surface 4*c* of the housing 4 of the tape printer 3 is covered with the photo stand 2. When the photo stand 2 is attached to the tape printer 3, the engaging protrusions 23, 24 provided to the left side frame portion 7*c* and the engaging protrusions 21, 22 provided to the right side frame portion 7*d* warp outward (toward the side of the outer surface of the printer 3). The engaging protrusions 23 and 24 are engaged with the engagement grooves 12 and 13, respectively, and the engaging protrusion 21 and 22 are engaged with the engagement groove 11. Thus, the photo stand 2 is tightly fixed to the tape printer 3 so that the photo stand 2 does not come off the tape printer 3 after the attachment. The engaging protrusions 21 to 24 are engaged with the predetermined respective engagement grooves 11 to 13. However, the order in which the engaging protrusions 21 to 24 are engaged with the respective engagement grooves 11 to 13 is not limited to the order described above. Any engaging protrusions 21 to 24 can be engaged first with the respective engagement grooves 11 to 13.

As shown in FIG. 10, in the state described above, the bottom portion 8 of the photo stand 2 and the feet 63, 64 (not shown in FIG. 10) provided on the lower surface 4*b* of the tape printer 3 contact the installed plane 75, and the tape printer 3 is inclined rightward with respect to the installed plane 75. Accordingly, the photograph 20 is held while oriented toward a direction that the picture side of the photograph 20 can be easily seen. The protrusion 6 provided to the lower surface 5*b* of the cover 5 prevents the tape printer 3 from falling, by contacting the installed plane 75, even when a force is applied to the tape printer 3 rightward in FIG. 10.

Figure 12:
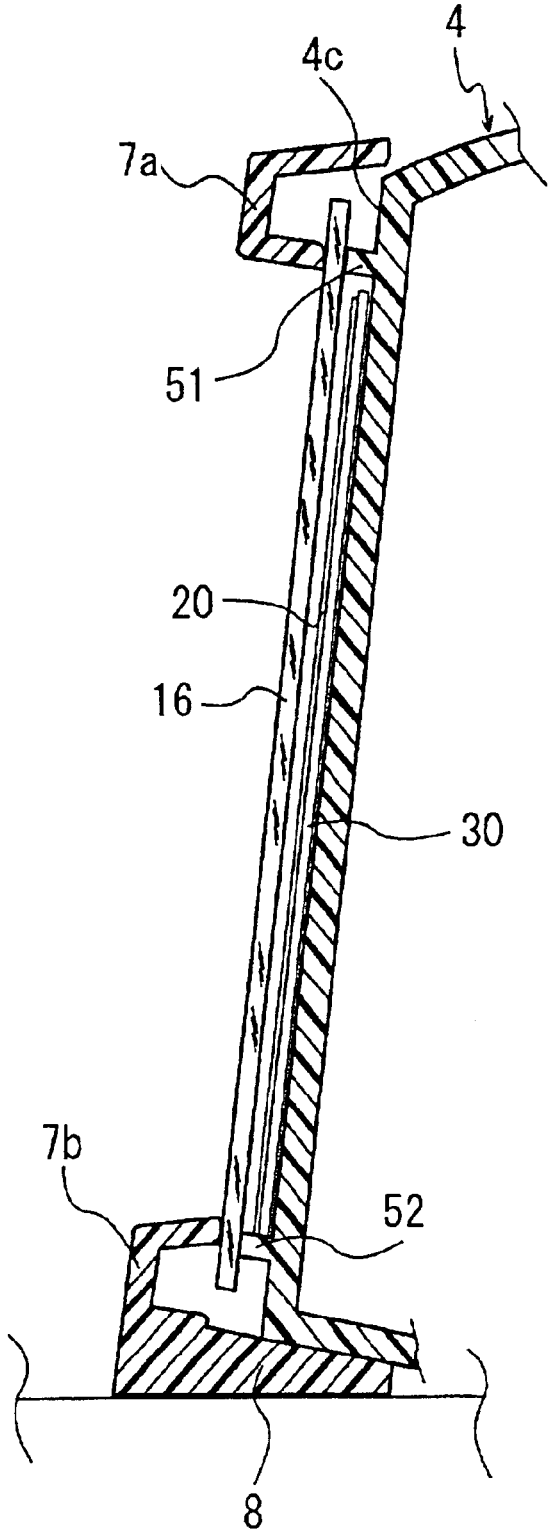
FIG. 12 is a sectional view taken along the line A—A of the FIG. 1, looking in the direction of the appended arrows.

As shown in FIG. 12, the photograph 20 is prevented from being vertically displaced by the protrusions 51, 52 provided to the left side surface 4*c* of the tape printer 3. The protrusions 51, 52 regulates the vertical movement of the photograph 20. The other protrusions 53, 54 also provided to the left side surface 4*c* function as the same as the protrusions 51, 52. Consequently, the photograph 20 is prevented from being vertically displaced.

As described above, according to the printer with the photo stand 1 of the embodiment, the tape printer 3 is attached with the photo stand 2 to form a single unit. Accordingly, space can be saved as compared with a case where the tape printer 3 and the photo stand 2 are separately located on a desk, for example. The bottom portion is formed such that the projected portion 8*c* inclinatorily projects toward the upper frame portion 7*a* from the lower surface 8*b*, forming an acute angle with the lower surface 8*b*. Accordingly, the photograph 20 is held in an inclined posture in the photo stand 2, so that the photograph 20 is oriented toward a direction that the photograph 20 can be easily seen. The protrusion 6 provided to the lower surface 5*b* of the cover 5 prevents the tape printer 3 from falling toward an inclined direction even when the tape printer 3 is inclined with respect to the installed plane 75. The protrusions 51 to 54 provided on the left side surface 4*c* of the tape printer 3 prevent the photograph 20 from being vertically displaced.

The photo stand 2 is removed from the tape printer 3 as described below. The engaging protrusions 23, 24 engaged with the engagement grooves 12, 13, respectively, provided to the rear surface 4*e* of the tape printer 3, are disengaged therefrom. Then, the engaging protrusions 21, 22 engaged with the engagement groove 11 provided to the front surface 4*d* of the tape printer 3, are released therefrom. Thus, the photo stand 2 is removed from the tape printer 3. At that time, the engaging protrusions 21 to 24 warp outward and are disengaged from the respective engagement grooves 11 to 13. Any engaging protrusions 21 to 24 can be released first from the respective engagement grooves 11 to 13.

Although the invention has been described in detail with reference to a specific embodiment thereof, it would be apparent to those skilled in the art that various changes and modifications may be made therein without departing from the spirit of the invention. In the embodiment, the photograph 20 is supported from its rear by the cardboard 30 and is prevented from being vertically displaced by the protrusions 51 to 54 provided on the left side surface 4*c* of the housing 4 of the tape printer 3. However, in order to reduce a parts count, for example, the photograph 20 may be held from its rear by the only protrusions 51 to 54. Engagement mechanisms for attaching the photo stand 2 to the tape printer 3 can have symmetric shape and can be provided at symmetric positions. In the embodiment, the tape printer 3 is used as an example. However, an object to be attached with the photo stand is not limited to the tape printer, but various kinds of printers can be attached with the photo stand.

The outer surfaces of the tape printer 3 are formed with the engagement grooves 11 to 13. The photo stand 2 is attached to the tape printer 3 via the engagement grooves 11 to 13. The photo stand 2 includes the frame 7 in which the middle portion is open, the engaging protrusions 21 to 24 that are provided on the rear surface of the frame 7 and engage the respective engagement grooves 11 to 13 formed in the tape printer 3, the transparent panel 16 that covers the surface of the photograph 20 so as to be able to be seen therethrough, the cardboard 30 that holds the photograph 20 with the transparent panel 16 from the rear side of the frame 7, and the photo holding portion that is integrally formed to the base portion of each engagement protrusion 21 to 24 and urges the photograph 20 by contacting the cardboard 30.

In the printer with the photo stand 1 structured as described above, the engagement grooves 11 to 13 are formed in the outer surfaces of the tape printer 3. The engaging protrusions 21 to 24 formed to the rear side of the frame 7 of the photo stand 2 are engaged with the respective engagement grooves 11 to 13. Accordingly, the photo stand 2 is attached to the predetermined surface while oriented in a predetermined direction. Consequently, the photo stand 2 can be prevented from being attached to an improper surface of the tape printer 3 and from being attached to the tape printer 3 in an improper orientation.

In the printer with the photo stand 1 of the embodiment of the invention, the cardboard 30 has the cutaway portion 30*a* that is formed by cutting away from one side so as to be opened with a substantially U-shape. The cardboard 30 is formed with the cutaway portion 30*a* from the one side. The cardboard 30 holds the photograph 20 with the transparent panel 16 that covers the surface of the photograph 20 so that the photograph 20 can be seen through the transparent panel 16. Accordingly, the photograph 20 can be easily removed from the photo stand 2 by inserting a finger into the cutaway portion 30*a*.

The frame 7 is provided with the bottom portion 8 that extends in a direction smaller than a right angle by a predetermined angle with respect to the frame 7. The tape printer 3 is inclined at the predetermined angle with respect to a direction perpendicular to the installed plane 75 of the tape printer 3 when the tape printer 3 is attached with the photo stand 2 having the bottom portion 8. Accordingly, the photograph 20, or the like, inserted in the photo stand 2 is held in a posture that it can be easily seen.

In the printer with the photo stand 1, the left side surface 4*c* (FIGS. 2 and 12) to which the photo stand 2 is to be attached is provided with the protrusions 51, 53 at its upper positions and the protrusions 52, 54 at lower positions. With this structure, the photograph 20 held in the photo stand 2 can be prevented from being vertically displaced.

The lower surface 5*b* of the cover 5 is provided with the protrusion 6 that prevents the tape printer 3 inclined at the predetermined angle from falling in a direction of the installed plane 75. Therefore, the tape printer 3 inclined at the predetermined angle can be prevented from falling.

The engagement grooves 11 to 13 may be formed in asymmetric positions. The photo stand 2 is detachably attachable to the tape printer 3 via the engagement grooves 11 to 13 formed at the outer surfaces of the tape printer 3. The photo stand 2 includes the frame 7 in which the middle portion is open, the engaging protrusions 21 to 24 that are provided on the rear surface of the frame 7 and engage the respective engagement grooves 11 to 13 formed in the tape printer 3, the transparent panel 16 that covers the surface of the photograph 20 so as to be able to be seen therethrough, the cardboard 30 that holds the photograph 20 with the transparent panel 16 from the rear side of the frame 7, and the photo holding portion that is integrally formed to the base portion of each engagement protrusion 21 to 24 and urges the photograph 20 by contacting the cardboard 30.

The engagement grooves 11 to 13 are formed in the outer surfaces of the tape printer 3. The engaging protrusions 21 to 24 are formed to the rear side of the frame 7 of the photo stand 2. The engaging protrusions 21 to 24 of the frame 7 are engaged with the respective engagement grooves 11 to 13 formed in the tape printer 3. Accordingly, the photo stand 2 is attached to the predetermined surface while oriented in a predetermined direction. Consequently, the photo stand 2 can be prevented from being attached to an improper surface of the tape printer 3 and from being attached to the tape printer 3 in an improper orientation.

In the photo stand 2 of the embodiment of the invention, the cardboard 30 has the cutaway portion 30*a* that is formed by cutting away from one side so as to be opened with a substantially U-shape. The cardboard 30 is formed with the cutaway portion 30*a* from the one side. The cardboard 30 holds the photograph 20 with the transparent panel 16 that covers the surface of the photograph 20 so that the photograph 20 can be seen through the transparent panel 16. Accordingly, the photograph 20 can be easily removed from the photo stand 2 by inserting a finger into the cutaway portion 30*a*.

In the photo stand 2, the frame 7 is provided with the bottom portion 8 that extends in a direction smaller than a right angle by a predetermined angle with respect to the frame. Accordingly, the photograph 20 or the like inserted in the photo stand 2 is held in a posture so that it can be easily seen.

What is claimed is:

1. A printer with a photo stand that prints indicia on a recording medium, comprising:

a printer having an outer surface; and a plurality of engagement portions formed in the outer surface of the printer, wherein the photo stand is detachably attached to the engagement portions.

2. The printer with the photo stand according to claim 1, wherein the photo stand includes:

a frame in which a middle portion is open;

a plurality of engaging protrusions that are provided on a rear surface of the frame and engage the respective engagement portions formed in the printer; and a photograph holding portion that is integrally formed to a base portion of each engagement protrusion and urges a photograph.

3. The printer with the photo stand according to claim 2, wherein the frame of the photo stand is provided with a bottom portion having a plurality of recessed portions formed in an upper surface of the bottom portion to receive feet of the printer.

4. The printer with the photo stand according to claim 1, wherein the photo stand includes a frame and the frame is provided with a bottom portion that extends in a direction smaller than a right angle by a predetermined angle with respect to the frame, and the printer is inclined at the predetermined angle with respect to a direction perpendicular to an installed plane of the printer when the printer is attached with the photo stand having the bottom portion.

5. The printer with the photo stand according to claim 4, wherein a bottom of the printer is provided with a protrusion that prevents the printer inclined at the predetermined angle from falling in a direction of the installed plane.

6. The printer with the photo stand according to claim 1, wherein the surface of the printer to which the photo stand is to be attached is provided with protrusions at its upper and lower portions.

7. The printer with the photo stand according to claim 6, wherein the protrusions are equally positioned at four corners of the surface of the printer to which the photo stand is to be attached.

8. The printer with the photo stand according to claim 1, wherein the photo stand includes:

a frame in which a middle portion is open;

a plurality of engaging protrusions that are provided on a rear surface of the frame and engage the respective engagement portions formed in the printer;

a transparent panel that covers a surface of the photograph so as to be able to be seen therethrough;

a rear panel that holds the photograph with the transparent panel from the rear side of the frame; and a photograph holding portion that is integrally formed to a base portion of each engagement protrusion and urges photograph.

9. The printer with the photo stand according to claim 8, wherein the rear panel includes a cutaway portion that is formed by cutting away from one side so as to be opened with a substantially U-shape.

10. The printer with the photo stand according to claim 1, wherein the engagement portions are formed in symmetric positions at a periphery of the printer.

11. The printer with the photo stand according to claim 1, wherein the photo stand includes:

a frame in which a middle portion is open;

a plurality of engaging protrusions that are provided on a rear surface of the frame and engage the respective engagement portions formed in the printer;

a transparent panel that covers a surface of the photograph so as to be able to be seen therethrough; and a photograph holding portion that is integrally formed to a base portion of each engagement protrusion and urges photograph.

12. The printer with the photo stand according to claim 1, wherein the engagement portions are formed in symmetric positions at a periphery of the printer.

13. A photo stand detachably attachable to a printer via a plurality of engagement portions formed in an outer surface of the printer, comprising:

a frame in which a middle portion is open;

a plurality of engaging protrusions that are provided on a rear surface of the frame and engage the respective engagement portions formed in the printer; and a photograph holding portion that is integrally formed to a base portion of each engagement protrusion and urges a photograph.

14. The photo stand according to claim 13, wherein the frame is provided with a bottom portion that extends in a direction smaller than a right angle by a predetermined angle with respect to the frame.

15. The photo stand according to claim 13, further comprising:

a transparent panel that covers a surface of the photograph so as to be able to be seen therethrough.

16. The photo stand according to claim 15, further comprising:

a rear panel that holds the photograph with the transparent panel from the rear side of the frame.

17. The photo stand according to claim 13, further comprising:

a rear panel that holds the photograph from the rear side of the frame.

18. The photo stand according to claim 17, wherein the rear panel includes a cutaway portion that is formed by cutting away from one side so as to be opened with a substantially U-shape.

19. The photo stand according to claim 13, wherein the frame is provided with a bottom portion having a plurality of recessed portions formed in an upper surface of the bottom portion to receive feet of the printer when the photo stand is attached to the printer.

20. The photo stand according to claim 13, wherein the frame has convexly curved surface portions.

21. A printer with a photo stand that prints indicia on a recording medium, comprising:

a printer having an outer surface; and a plurality of engagement portions formed in the outer surface of the printer, wherein the photo stand is detachably attached to the engagement portions and includes an opening whose size is substantially the same as a size of a photograph.

22. The printer with the photo stand according to claim 21, wherein the photo stand includes:

a frame that has the opening at a middle portion;

a plurality of engaging protrusions that are provided on a rear surface of the frame and engage the respective engaging protrusions formed in the printer; and a photograph holding portion that is integrally formed to a base portion of each engagement protrusion and urges the photograph.

* * * * *